US005785319A

United States Patent [19]

Frauhiger

[11] Patent Number: 5,785,319

[45] Date of Patent: Jul. 28, 1998

[54] RE-ARRANGABLE THREE-DIMENSIONAL PICTURE DISPLAY INCORPORATING A PICTURE PUZZLE

[76] Inventor: Robert Frauhiger, 12 Continental Club, Hilton Head Island, S.C. 29928

[21] Appl. No.: 824,326

[22] Filed: Mar. 26, 1997

[51] Int. Cl.[6] ..... A63F 9/08

[52] U.S. Cl. ..... 273/157 R

[58] Field of Search ..... 273/157 R, 153 R, 273/156

[56] References Cited

U.S. PATENT DOCUMENTS

| | | | |
|---|---|---|---|
| 477,633 | 6/1892 | Barringer | 273/157 R |
| 1,709,660 | 4/1929 | De Bracht | 273/157 R |
| 1,964,007 | 6/1934 | Parks | 273/157 R |
| 2,041,030 | 5/1936 | Strutton | 273/157 R |
| 2,201,724 | 5/1940 | Gable | 273/157 R |
| 2,886,325 | 5/1959 | Long | 273/157 R |

*Primary Examiner*—Steven B. Wong

*Attorney, Agent, or Firm*—Rosenberg, Klein & Bilker

[57] ABSTRACT

A displaying device for displaying pictures of baseball players, or the like, includes a three-dimensional (3D) structure including identically sized cube elements, provided with a respective picture fragment of each of the face surfaces. Being solved, the 3D structure exposes meaningful pictures on each of its six external flats. The displaying device is re-arrangeable for exposing a larger number of the pictures by separating the 3D structure into blocks—layers, each of which exposes meaningful pictures of its both opposite planes.

9 Claims, 5 Drawing Sheets

RE-ARRANGABLE THREE-DIMENSIONAL PICTURE DISPLAY INCORPORATING A PICTURE PUZZLE

BACKGROUND OF THE INVENTION

1. Field of the Invention

This invention relates generally to a three-dimensional (3-D) picture display, and more particularly, to a 3-D picture display comprising a picture puzzle suitable for being used by people of different levels of intellectual capacity and serving for displaying pictures related to a certain subject, for instance, sport pictures.

2. Prior Art

Over the years, a variety of types of puzzles has been developed, serving as amusement devices, as teaching tools, and for educational purposes. These puzzles provide enjoyment and entertainment, and also facilitate in developing of children's perception of certain knowledge.

For instance, U.S. Pat. No. 2,886,325 discloses a three-dimensional crossword puzzle, comprising 125 cubical blocks having a letter or blank on each face thereof and adapted to be arranged in a cube consisting of five layers of blocks, each layer constituting an independent puzzle of twenty-five cubes. Each face of the cubical blocks bears a surface designation (color), and the surfaces with identical surface designation are exposed on the top of each layer. After five independent puzzles each having an identical surface designation (color) are solved, they are stacked one on the other, and the whole structure is turned 90 degrees in any direction, thereby exposing a layer having another surface designation on the top thereof. These layers are sequentially removed from the cube, placed onto a smooth surface, and another five independent puzzles are solved. The game continues further following the same algorithm until six sets of independent puzzles having different surface designations are solved.

This puzzle is primarily intended for entertainment and educational purposes, but not as a displaying device.

Multi-picture puzzles are popular among puzzle-solvers since they provide entertainment and are suitable for displaying solved pictures.

For instance, Des. Pat. No. 334,599 shows a puzzle toy comprising a three-dimensional structure of cube elements, each of which carries a part of a meaningful picture to be formed on a flat of the structure. Upon assembling the structure, each of six flats thereof displays a certain picture.

U.S. Pat. No. 4,741,534 discloses a multi-picture puzzle comprising a plurality of cubes each carrying a portion of a picture on each side thereof. The cubes are positioned on a base and are arranged in a block of a single cube width and with a displaying surface exposing respective sides of the cubes arranged in an array. The cubes may be re-arranged on the base so that to expose other sides thereof, thereby providing for six possible picture forming combinations. The cubes are secured to the base by means of magnetic attraction between the base and a ball inside of each cube.

U.S. Pat. No. 4,210,333 discloses a puzzle device having a set of cubes each provided with a visual matter on each of its faces. The cubes are arrangeable at least twice in a pre-determined way into a rectangular parallelepiped with the exposed faces of the cubes forming five of six external sides of the parallelepiped, so that the visual matter on the exposed faces of the cubes together form a predetermined visual format.

Although having certain advantages for their particular applications, the above-discussed picture puzzle devices use only external surfaces of a resulting structure, thereby limiting a number of pictures allowed to be displayed.

Besides, the afore-discussed puzzles, for being successfully solved and for displaying meaningful pictures of the external surfaces thereto, require the full set of the cube elements to be used. Therefore, each of them is intended for a certain level of intellectual capacity or for a certain age of a player, since the number of the cube elements involved in the puzzle solution determines the skill of a person capable of using the puzzle.

A picture displaying device providing for a higher degree of versatility, i.e., the large number of pictures to be displayed, without increasing the number of cube elements and also allowing entertainment for different skill levels, from children to adults, would be desirable.

SUMMARY OF THE INVENTION

Therefore, it is an object of the present invention to provide a three-dimensional picture display allowing a high number of meaningful pictures to be exposed not only on external surfaces of the three-dimensional structure, but also on internal surfaces thereof.

It is another object of the present invention to provide an "active" displaying device for sports (or other arts) fans, which would be able not only of performing a single function of displaying a certain picture of a favorite athlete or actor, etc., but also allowing to "re-arrange the displaying device" per se in order to display a variety of desired pictures; this "re-arrangement" would further extend the enjoyment and would add an element of fun to the displaying device in question.

It is still an object of the present invention to provide a three-dimensional picture display comprising a picture puzzle and allowing a wide range of users, from children to adults, to be able to use it.

It is yet another object of the present invention to provide a three-dimensional picture display incorporating a puzzle structure exposing, upon solving thereof, a respective meaningful picture on each of the six external flats of the structure, and separable in three mutually perpendicular directions thereof into a number of blocks in each direction, with each block exposing a respective meaningful picture on two opposite sides thereof.

It is a further object of the present invention to provide a method of displaying desired pictures by means of solving a puzzle, thereby creating a three-dimensional master structure displaying meaningful pictures on six surfaces thereof, and by re-arranging the master structure for displaying a larger number of desired meaningful pictures previously "hidden" on "internal" surfaces of the master structure.

It is still an object of the present invention to provide a method of solving a picture puzzle by arranging cube elements in a three-dimensional structure exposing meaningful pictures on all six external flats thereof, and by uncovering meaningful pictures formed on "internal" surfaces of the three-dimensional structure.

The present invention may find particular utility as a picture stacking puzzle for players of different intellectual capacity. It also may find a broad application as a displaying device for being used by fans of different arts (sports, cinematography, etc.) for displaying the pictures of their favorite athletes, actors, celebrities, etc.

According to the teaching of the present invention, a three-dimensional picture puzzle display structure comprises a plurality of parallelepipedly contoured block members (which alternatively can be shaped as cube elements). Each of these block elements has a multiplicity of face surfaces defining internal and external faces (or surfaces) of the three-dimensional picture puzzle display structure. Each of the face surfaces of the block elements has a respective indicia formed thereon. In the three-dimensional display structure, each of the block elements is predeterminedly interfaced with respect to the other in releasable, mating and pre-arranged manner to form at least one of the pictures on both the internal and external faces of the mated block elements.

Viewing in another aspect of the present invention, three-dimensional picture displaying device incorporates a picture puzzle which includes block elements (or cube elements) each face surface of which is provided with a respective picture fragment (or indicia). Once assembled in the three-dimensional structure (or the master structure), these picture fragments, in proper combination thereof, form meaningful pictures (pictures of athletes, celebrities, etc.) exposed on each of the six external flats of the master structure.

The essence of the displaying device of the present invention which allows an user to arrive to a high degree of entertaining, is the opportunity to uncover and to expose many more pictures of favorite celebrities by simply "slicing" the master structure in any one of three mutually perpendicular directions into respective blocks of one cube element's width, with a respective picture on each of the two opposite planes of each block, with each of the opposite planes defined by respective face surfaces of respective cube elements (or block elements). Each block, therefore, can itself serve as a display for displaying two pictures.

Preferably, in the displaying device having N^3 cube elements (or block elements) arranged in a master cube with a flat including N^2 cube elements, the number of blocks "sliced out" in each of three perpendicular directions is N. Therefore, the number of pictures available in such a structure is 6N. With 6N possible combinations allowed, the displaying device of the present invention will never frustrate the user by having him/her be bored. Neither will the user be frustrated by excessive difficulty, since once the master cube has been properly assembled, with meaningful pictures on external flats thereof, then the "sliced out" blocks will automatically have meaningful pictures on their both planes.

Viewing in another aspect thereof, the present invention is a picture stacking puzzle having a plurality of cube elements each carrying a picture fragment on each of its surfaces. The cube elements can be arranged in a master three-dimensional structure having a respective picture on each of the external flats of the master structure. The master structure can be separated into "two-dimensional" blocks of a single cube element's width with a plane of separation parallel to either one of the external flats of the master structure. Each block has two opposite surfaces exposing meaningful pictures thereon.

Viewing in still further aspect thereof, the present invention is a method of displaying pictures by providing cube elements (or block elements) carrying a respective picture fragment (or indicia) on each surface (of face surface) thereof; selecting, in sequence, respective sets of the cube elements and arranging each set in a "two-dimensional" first block with a single cube element's width and with the pair of opposite planes, so that each of the opposite planes of each block is defined by respective face surfaces of respective cube elements and exposes a meaningful picture thereon. Preferably, the blocks are stacked together in such an order that to form a three-dimensional master structure and such that to expose meaningful pictures on each of the six flats thereof. After the three-dimensional master structure has been properly arranged, the three-dimensional structure is "sliced" into blocks similar to the first blocks but in any one of two planes mutually perpendicular to the plane of the first blocks. As the result, each of newly obtained blocks will uncover a pair of desired pictures.

Availability of a "two-dimensional" block to play with, alternatively to a "three-dimensional" structure, is beneficial for those with a lower intellectual capacity, since it involves fewer cube elements and will not cause frustration for being too difficult.

The puzzle-displaying device of the present invention can be supplemented with a pedestal for supporting a master structure and with a transparent casing for being removably secured to the pedestal, thereby keeping the master structure to the place.

These and other objects of the present invention will become more apparent from reading the following description in conjunction with the drawings.

DETAILED DESCRIPTION OF THE INVENTION

Figure 1:
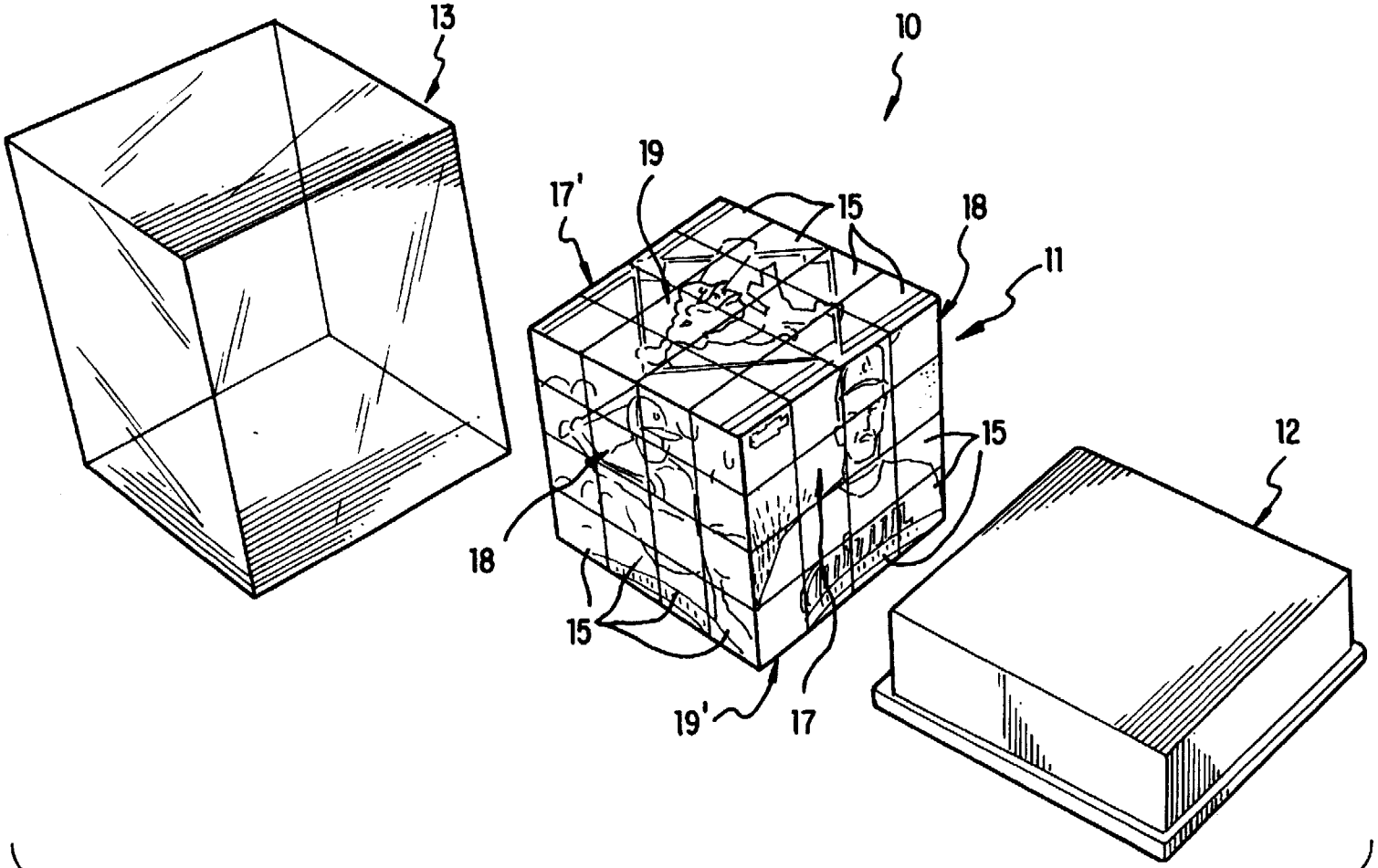
FIG. 1 is a perspective exploded view of the displaying device of the present invention, showing a three-dimensional structure, a pedestal and a casing altogether constituting a complete display set of the present invention.

Referring to FIGS. 1–5, a displaying device 10 for displaying pictures includes a three-dimensional structure 11, a pedestal 12 for supporting the three-dimensional structure 11, and a transparent casing 13 for being removably secured to the pedestal 12 for covering the three-dimensional structure 11, securing it to place, protecting from falling apart, and also for preventing from unwanted environmental precipitations and dust.

The following description will proceed particularly related to a cube-shaped three-dimensional structure 11, however, the principles and teaching of the present invention are equally applicable to three-dimensional structures forming rectangular parallelepipeds of different configuration. Besides, although particularly drafted to a sport thematic, it will be appreciated by those skilled in the art, that any subject to be displayed is appropriate in lieu of the present invention.

The three-dimensional structure 11 is arranged from a plurality of identically sized parallelepipedly contoured elements, each having six face surfaces, further referred to as surfaces. Although, these parallellepipedly contoured elements are shown in FIGS. 1–5 as cubes and are further referred to as cube elements 14, it will be understood by those skilled in the art that any parallelepipedly contoured block elements of different configurations would be appropriate in view of the present invention. Each of the six surfaces 15 of the cube elements 14 is provided with an indicia constituting a respective picture fragment 16 of a meaningful picture, for instance, a picture of a baseball player. It is understood, that no two surfaces 15 of the same cube element 14 carry fragments of the same picture; therefore, each cube element 14 participates in forming of six different pictures. As described, the cube elements 15 can also be considered as elements of a picture stacking puzzle which should be solved in order to perform displaying functions. In lieu of this, the three-dimensional structure 11 will be further referred to as a master cube 11 which is a master solution of the puzzle which is a major element of the displaying device 10 of the present invention.

Different numbers of cube elements 14 can be appropriate for implementation of the present invention, however, since, for sake of simplicity and for better understanding of the description, the three-dimensional structure is asumed to be a cube, then N^3 cube elements 14 for forming the master cube 11 with N^2 cube elements 14 exposed on each of its external flats, are also assumed.

The master cube 11 has three pairs 17 and 17', 18 and 18', 19 and 19' of opposite external flats, each pair being mutually perpendicular to each other. Once being properly arranged into the master cube 11, the picture fragments 16 carried by surfaces 15 of cube elements 14 exposed on the external flats 17 and 17',18 and 18',19 and 19', form meaningful pictures of baseball players.

Figure 2:
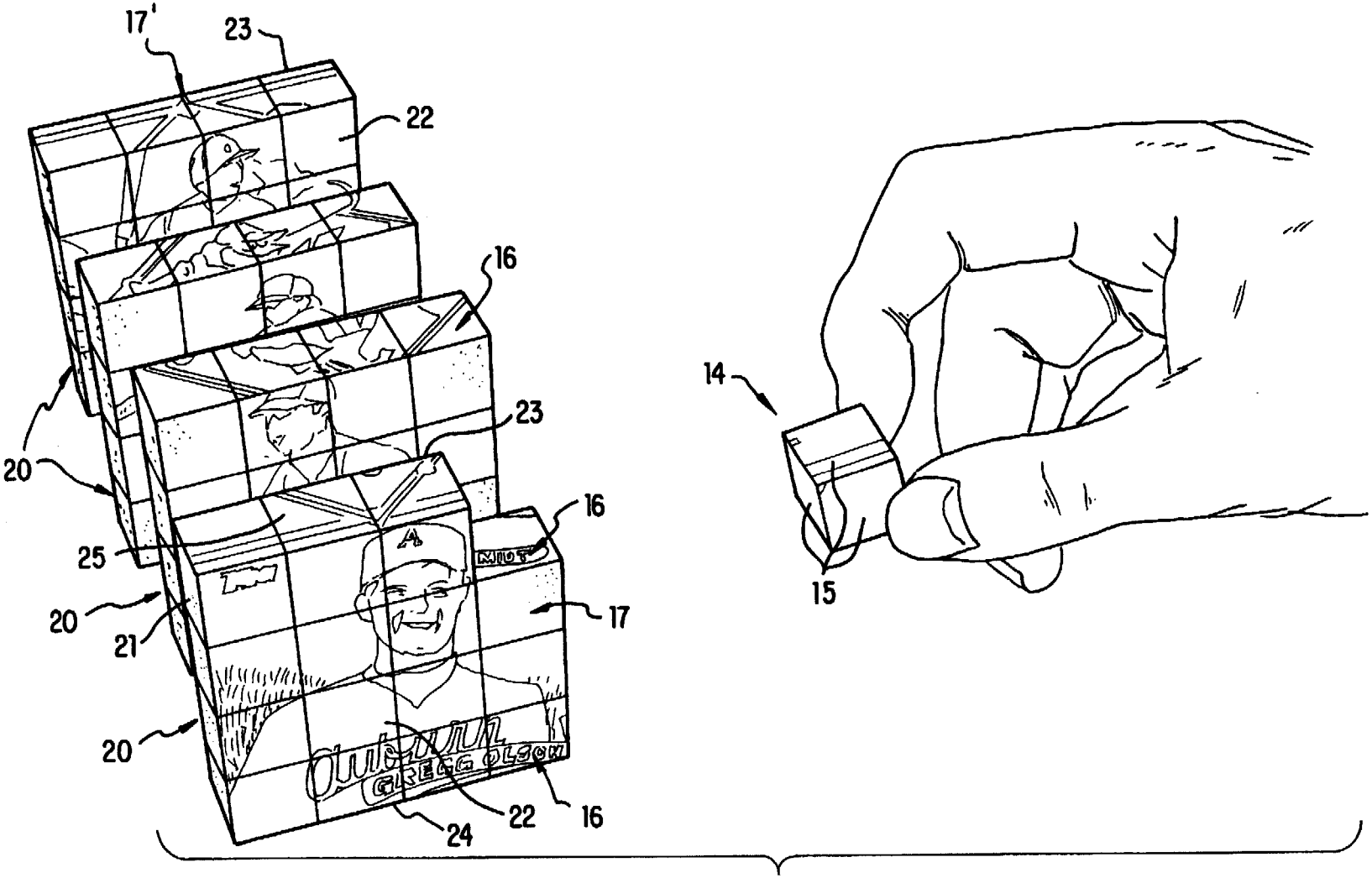
FIG. 2 is a perspective exploded view showing a sequence of steps for assembling the three-dimensional structure of the present invention.

Different algorithms of arranging the cube elements 14 into the master cube 11 are appropriate. For example, as best shown in FIG. 2, a user selects N sets of cube elements 14, with each set containing N^2 cube elements 14 and arranges each set into a single block 20 with a width of a side 21 thereof corresponding to a single cube element 14 and having a pair of opposite planes 22 and 23. The user arranges the cube elements 14 in the block 20 in such a way, that the picture fragments 16 on the surfaces 15 exposed to the planes 22 and 23, form meaningful pictures thereon.

Although not shown in the drawings, it is the essential feature of the present invention, that once the block 20 is assembled with one plane, for example, 22 exposing a meaningful picture, then another plane, for example, 23 automatically exposes another meaningful picture (or identical, if desired). Once the first block 20 has been assembled, the second, the third and the following blocks 20 are to be assembled in sequence, if it is desired to build a master cube 11.

However, arranging the displaying device of the present invention can be stopped once the first block 20 has been built, for example, for a young child, for whom to arrange N^2 cube elements in a meaningful picture is a sufficient challenge. The great advantage of the displaying device 10 in question that this single block 20 can be considered as a displaying structure capable of displaying two pictures.

People with a higher skill level may continue to any desired extent, the most challenging of which is arranging the cube elements 14 into the master cube 11.

As discussed above, and as best shown in FIG. 2, N blocks 20 are to be built in order to assemble them into the master cube 11. Each of the blocks 20 has a meaningful picture on their both planes 22,23. In order to assemble the master cube 11, the N blocks 20 are arranged in parallel to each other and are adjoined with the planes 22 and 23, respectively, of two adjacent blocks 20 facing each other (in the master cube 11, these adjoined planes 22, 23 constitute obscure, or internal surfaces thereof).

In order to properly built the master cube 11, all external flats 17 and 17',18 and 18',19 and 19' are to expose meaningful pictures. Therefore, the great care should be taken to arrange the blocks 20 in the proper order. For this purpose, the blocks 20 are adjoined to each other in such a way that the picture fragments carried by surfaces of the cube elements 14 exposed on either of the opposite sides 21 of the blocks 20, or on either of a bottom 24 or a top 25 of the blocks 20, form respective meaningful pictures on the flats 18 and 18', 19 and 19', while the plane 22 of the first block 20 becomes the external flat 17 of the master cube 11, and the plane 23 of the Nth block 20 becomes the external flat 17' of the master cube 11. It will be appreciated by those skilled in the art, that the picture fragments 16 on the cube elements 14 are arranged in such a manner that once any two perpendicular adjacent external flats of the master cube 11 has exposed meaningful pictures, other four (4) external flats of the master cube 11 will automatically form respective meaningful pictures thereon.

As best shown in FIG. 1, the properly assembled master cube 11 carries meaningful pictures on all six external flats thereof. If desired, the master cube 11 can be placed onto the pedestal 12 and covered by the casing 13 for being displayed.

Figure 3:
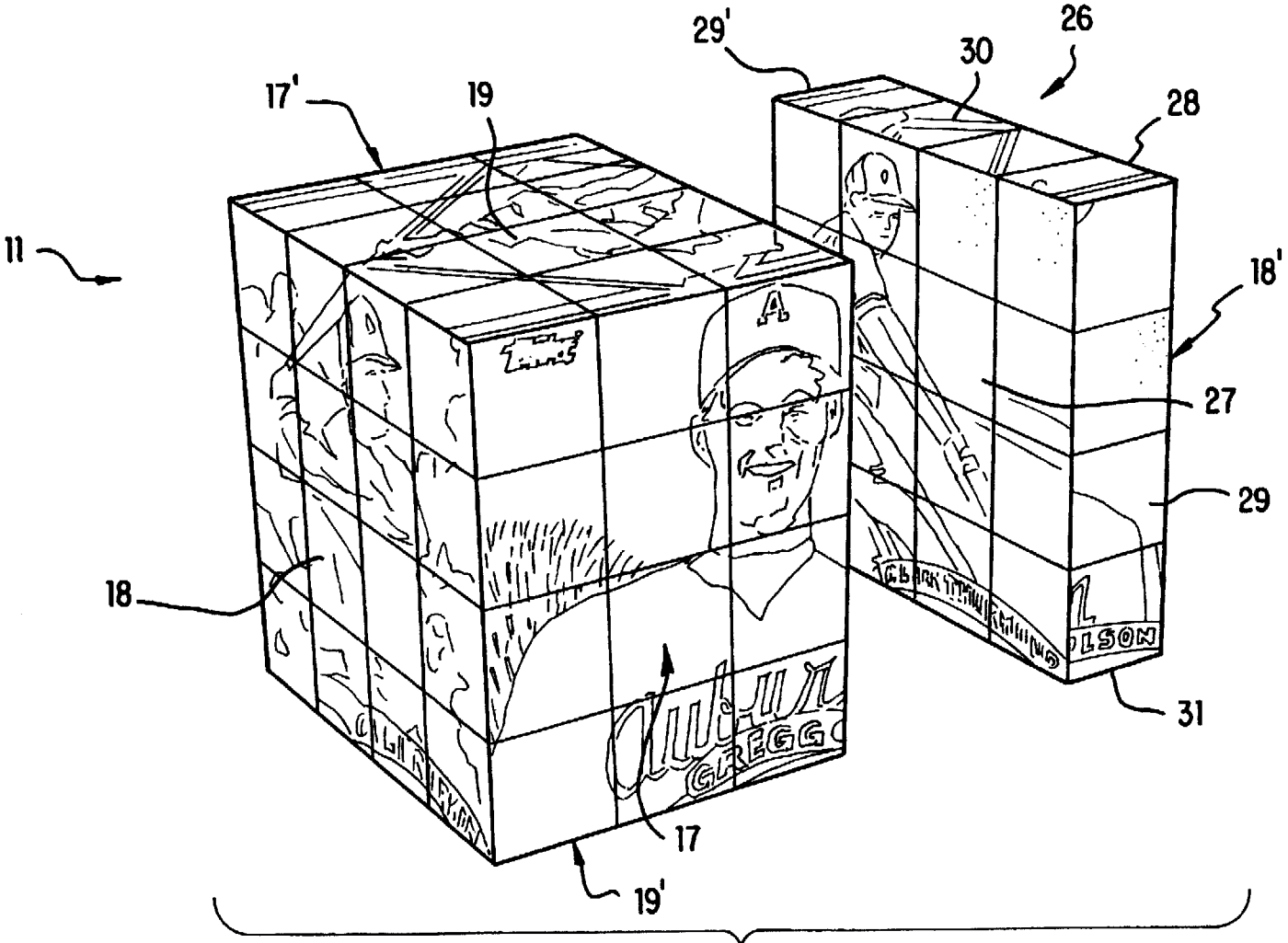
FIG. 3 is a perspective exploded view showing the further steps of re-arranging the displaying device of the present invention, wherein the assembled three-dimensional structure has been "sliced" so that to separate a single block in a direction perpendicular to the direction of assembling the three-dimensional structure, shown in FIG. 2, thereby uncovering the picture on two of the internal surfaces of the three-dimensional structure.
Figure 4:
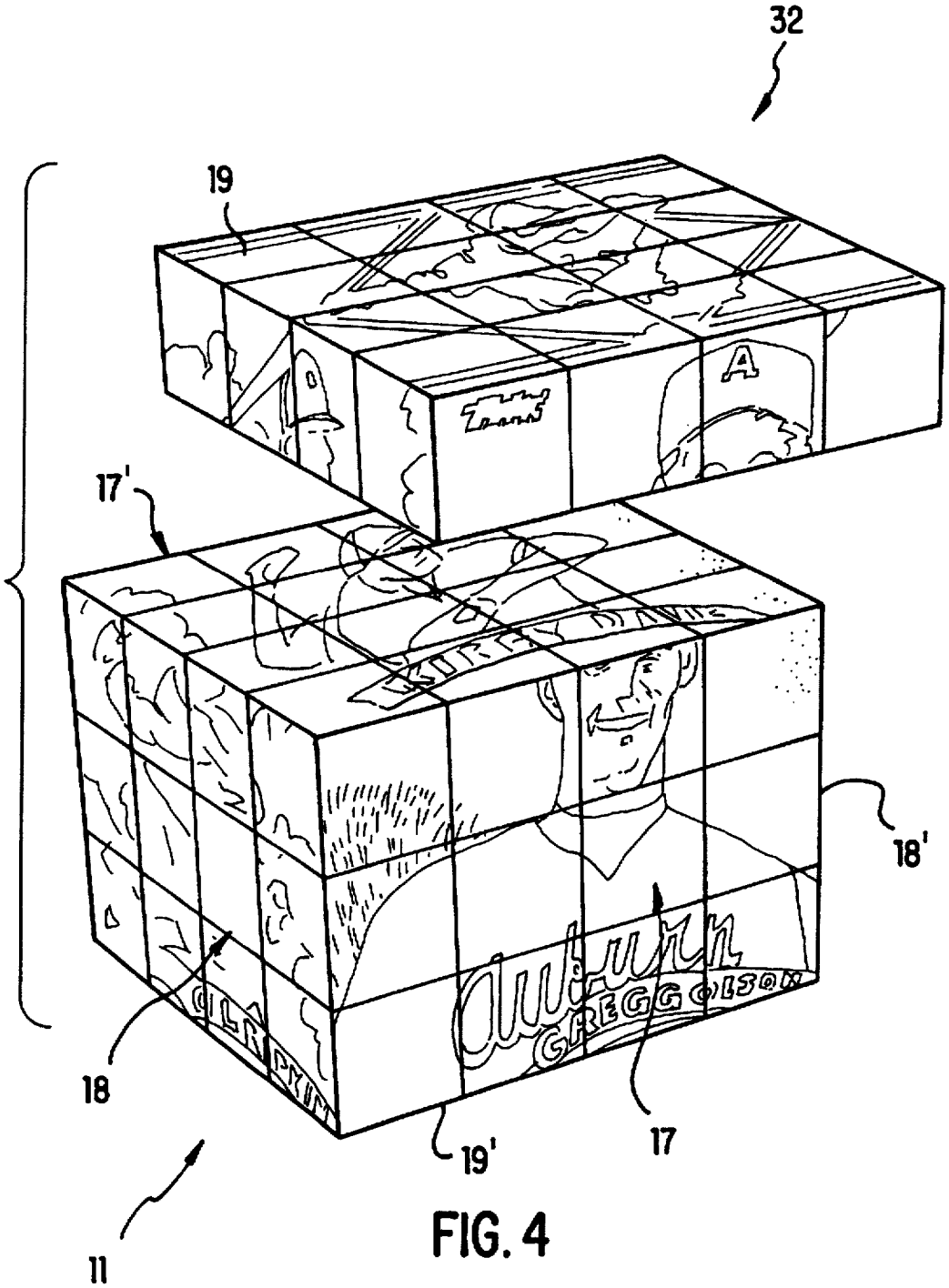
FIG. 4 is a perspective exploded view showing the displaying device of the present invention "sliced" in another (horizontal) direction thereby revealing the pictures on horizontal internal surfaces of the three-dimensional structure.

If more pictures are desired to be displayed, the master cube 11 is "sliced" in either one of mutually perpendicular directions, i.e., either in parallel to the flats 18 and 18', or in parallel to the flats 19 and 19', as best shown in FIGS. 3 and 4, thereby uncovering "internal" (or obscure) surfaces of the master cube 11 carrying respective meaningful pictures thereon.

With respect to FIG. 3, a block 26 having opposite planes 27 and 28, sides 29 and 29', a top 30 and a bottom 31, is separated from the master cube 11 in parallel to the flats 18 and 18' thereof. As it is understood, the plane 28 of the block 26 coincides with the external flat 18', and reveals a respective meaningful picture; the plane 27 constitutes one of the obscure surfaces of the master cube 11 which has been uncovered by "slicing" the master cube 11 and exposes a respective meaningful picture; the top 30 of the block 26 is a part of the external flat 19; the bottom 31 of a block 26 is a part of the external flat 19'; the sides 29 and 29', respectively, are the parts of the external flats 17 and 17', respectively. Both planes 27 and 28 of the block 26 expose meaningful pictures thereon. The process of slicing the master cube 11 can be continued sequentially separating the rest of blocks 26 parallel to the first block 26, as shown in FIG. 3. Each of the planes 27 and 28 of the blocks 26 will expose pictures for being displayed by a user.

As shown in FIG. 4, the master cube 11 can be also "sliced" in parallel to the flats 19 and 19', thereby forming blocks 32. This step is similar to those shown in FIG. 3, and therefore, is not intended to be discussed in detail herein. It is important, however, to emphasize that each uncovered internal surface of the master cube 11, which coincides with planes of the block 32, carries a meaningful picture thereon. The user, is desired, can display any of these surfaces.

As will be appreciated from the foregoing discussion, for the displaying device of the present invention comprising N^3 cube elements 14, 6N possible combinations of pictures are allowed. For example, as shown in FIGS. 1–5, with the master cube 11 assembled from sixty four (64) cube elements 14, twenty four (24) pictures of favorite athletes (or other celebrities) are allowed to be uncovered and displayed.

Figure 5:
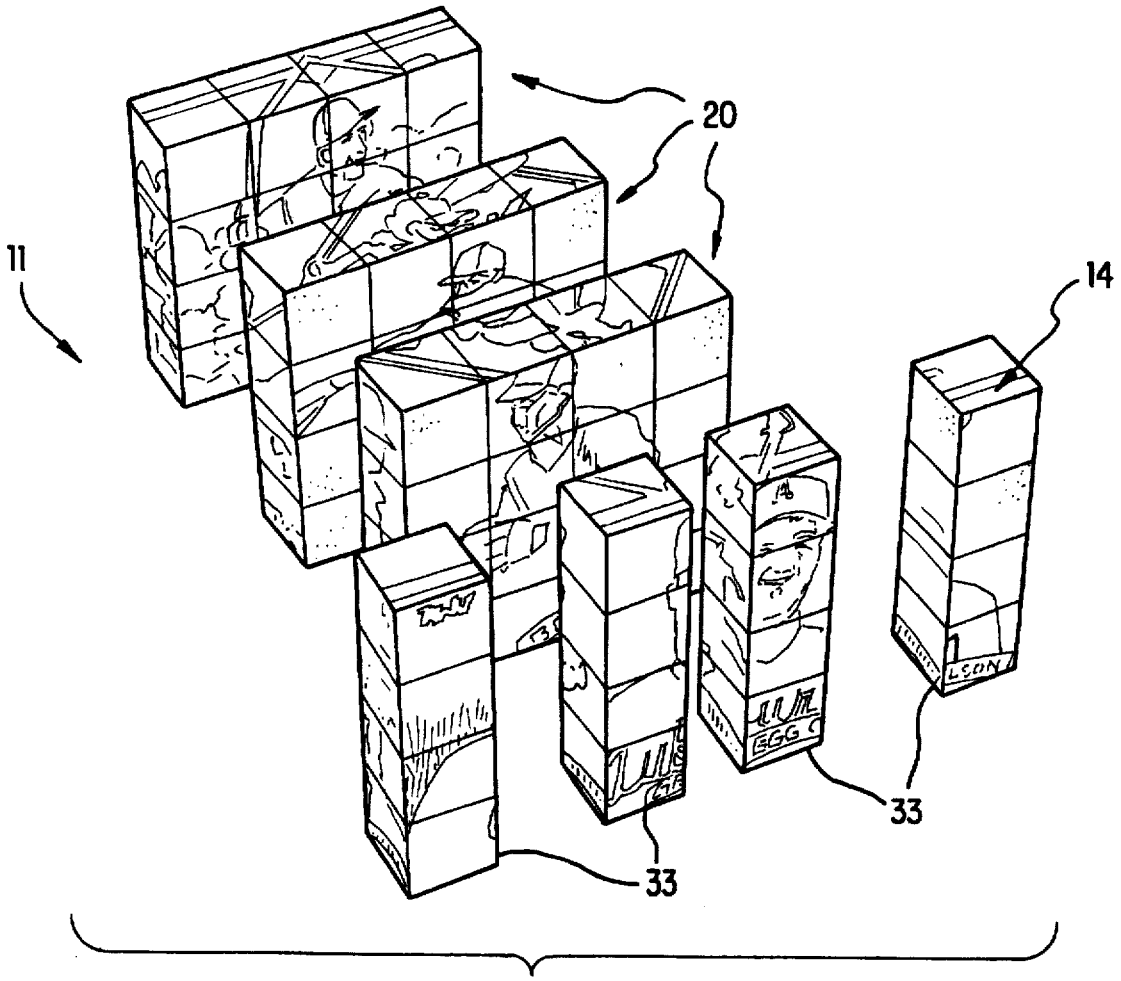
FIG. 5 shows an alternative sequence of steps for assembling the three-dimensional structure of the present invention.

It will be also appreciated by those skilled in the art, that although as described, the blocks 20 are first built and combined into the master cube 11, and the blocks 26 and 32 are further "sliced out" of the master cube 11, it is perfectly appropriate to first built blocks 26 or 32, and arrange them into the master cube 11, and, afterward, to slice the master cube 11 into the blocks 20 and 32, or 20 and 26. Another alternative exists for building the blocks 20 (or 26 and 32), including, as best shown in FIG. 5, first to arrange cube elements 14 into vertical "uni-directional towers" with height thereof of N cube elements, and then to combine these "towers" 33 into the block 20. This approach brings more excitement for young kids.

The present invention, as disclosed above, constitutes a displaying device comprising as a major element a picture stacking puzzle (preferably of three-dimensional structure, but for people with a lower skill level it can be considered as two-, and even uni-dimensional puzzle) allowing a larger number of pictures to be exposed and intended for being used by people with different intellectual capabilities. The present invention also constitutes a displaying device which besides the function of displaying pictures, is provided with ability to be re-arranged in order to change the number of pictures to be displayed. As described above, the three-dimensional picture puzzle display structure of the present invention comprises a plurality of block elements (or cube elements) 14 which are predeterminedly interfaced each in with respect to the other in releasable, mating and prearranged manner so that face surfaces (or surfaces) 15 of the block elements 14 define internal faces (or planes) 22, 23, 27, and 28 and external faces (or external flats) 17—17', 18—18', and 19—19' of the three-dimensional structure 11, and so that the pictures are formed on the internal and external faces thereof. The user may prefer to use the three-dimensional master cube 11 for exposing six pictures; or it can be either one, or several of the blocks 20, 26, and 32, each exposing two pictures thereon. It can be also a sliced out block 20, or 26, or 32 and the remaining part of the master cube 11.

All of these combinations and modifications of the present invention, and others which become apparent to those skilled in the art after exposure to these teachings, are within the scope of the subjoined claims.

What is claimed is:

1. A three-dimensional displaying device comprising a three-dimensional structure having three pairs of mutually perpendicular external flats and exposing a first predetermined number of respective meaningful and independent pictures thereon, wherein said three-dimensional structure further has a second predetermined number of internal surfaces thereof each extending substantially in parallel to a respective one of said pairs of external flats, and wherein said three-dimensional structure is rearrangeable to uncover a desired one of said internal surfaces thereof, each exposing respectively a meaningful and independent picture thereon, and wherein a predetermined arrangement of said structure defines a total number of said meaningful and independent pictures on said external flats and said internal surfaces, said total number corresponding to the sum of said first and second predetermined numbers of said external flats and internal surfaces, respectively.

2. The picture displaying device of claim 1, further comprising cube elements substantially identically sized and being provided with a respective picture fragment on each surface thereof, said cube elements being arranged in said three-dimensional structure, wherein each of said external flats of the three-dimensional structure includes respective surfaces of a group of said cube elements, and thereby exposes a meaningful and independent picture compiled of the picture fragments on said respective surfaces, and whereby said three-dimensional structure is rearrangeable by separation thereof into three sets of single blocks with the planes of each set of blocks being parallel to a respective one of said mutually perpendicular pairs of external flats, thereby uncovering said internal surfaces of the three-dimensional structure, each of said blocks having said cube elements arranged in an array thereof and being of a single cube element's width, wherein each of said blocks has a pair of opposite planes coinciding with respective ones of said internal surfaces and exposing a meaningful and independent picture comprising respective said picture fragments on each of said opposite planes.

3. The picture displaying device of claim 2, wherein said three-dimensional structure comprises a stacking picture puzzle, having N^3 said cube elements, with N>1, wherein each of said external flats and internal surfaces exposes N^2 cube elements, wherein said three-dimensional structure is separable into 3N blocks, with the planes of N blocks parallel to either one of said external flats, and wherein the total number of meaningful pictures exposable is 6N.

4. The three-dimensional structure of claim 3, wherein N equals four (4), and wherein the total number of meaningful pictures exposable is 24.

5. The three-dimensional structure of claim 1, wherein said pictures have sports thematic.

6. The displaying device of claim 3, wherein said three-dimensional structure is a master structure.

7. The displaying device of claim 1, further comprising a pedestal for supporting said three-dimensional structure and a transparent casing removably attachable to the pedestal and securing the three-dimensional structure therebetween.

8. A method of displaying independent pictures, comprising the steps of:

providing N^3 cube elements substantially identically sized and provided with a respective picture fragment on each surface thereof, with N>1, arranging said cube elements in a parallelepiped master structure having three pairs of opposite external flats thereof, so that each of said external flats includes respective surfaces of a group of said cube elements, thereby exposing a first predetermined number of meaningful and independent pictures compiled of the picture fragments on said respective surfaces, said master structure having a second predetermined number of internal surfaces arranged, respectively, in parallel with said pairs of external flats, displaying said meaningful and independent pictures on said external flats, and separating said parallelepiped master structure into single blocks, thereby uncovering at least one said internal surfaces of the master structure, each of said blocks comprising said cube elements arranged in an array thereof and being of a single cube element's width, wherein each of said blocks has a pair of opposite planes, at least one of which coinciding with a respective one of said internal surfaces of the master structure, and exposing a meaningful and independent picture on each of said opposite planes, and displaying respective meaningful and independent pictures formed on said opposite planes of at least one of said blocks, and wherein a predetermined arrangement of said structure defines a total number of said meaningful and independent puzzle pictures on said external flats and said internal surfaces, said total number corresponding to the sum of said first and second predetermined numbers.

9. The method of claim 8, further including the steps of:

prior to arranging said cube elements into said three-dimensional master structure, selecting, in sequence, first, second, . . . N−1, and N^th respective groups, each having N^2 of said cube elements, and arranging said N^2 cube elements of each of said first, second, . . . N−1, and N^th groups, respectively, in first, second, . . . N−1, and N^th blocks, each having a respective pair of opposite square planes, each of said first, second, . . . N−1, and N^th blocks being of a single cube element's width; and separably adjoining said first, second, . . . N−1, and N^th blocks with said square planes of adjacent of said first, second, . . . N−1 and N^th blocks facing each other, thereby forming the three-dimensional master structure.

* * * * *